US006472858B1

(12) United States Patent
Tanase

(10) Patent No.: US 6,472,858 B1
(45) Date of Patent: Oct. 29, 2002

(54) LOW VOLTAGE, FAST SETTLING PRECISION CURRENT MIRRORS

(75) Inventor: Gabriel E. Tanase, Cupertino, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 48 days.

(21) Appl. No.: 09/676,287

(22) Filed: Sep. 28, 2000

(51) Int. Cl.[7] ..... G05F 3/16; G05F 1/10
(52) U.S. Cl. ..... 323/315; 327/538
(58) Field of Search ..... 323/315, 313, 323/314, 311, 312; 327/534, 535, 536, 538, 541

(56) References Cited

U.S. PATENT DOCUMENTS 5,059,890 A * 10/1991 Yoshikawa et al. ..... 323/315
5,512,816 A * 4/1996 Lambert ..... 323/312
5,521,490 A * 5/1996 Manohar ..... 323/315
5,982,227 A * 11/1999 Kim et al. ..... 327/543
5,990,727 A * 11/1999 Kimura ..... 327/513

* cited by examiner

*Primary Examiner*—Rajnikant B. Patel
(74) *Attorney, Agent, or Firm*—Blakely, Sokoloff, Taylor & Zafman LLP

(57) ABSTRACT

Low voltage, fast settling precision current mirrors and methods. The precision current mirror have first and second current mirrors, each having an input to be mirrored and a mirror output, the current mirrors being coupled so that the mirror output of each current mirror receives part of the input to be mirrored by the other current mirror, the first current mirror also mirroring current for re-mirroring to the input of the second current mirror, and to a precision current mirror output in proportion to the current provided to the input of the second current mirror. Various embodiments are disclosed, including MOS and junction transistor embodiments, and an embodiment having increased output impedance.

Details of the method are disclosed.

18 Claims, 6 Drawing Sheets

LOW VOLTAGE, FAST SETTLING PRECISION CURRENT MIRRORS

BACKGROUND OF THE INVENTION

1. Field of the Invention

The present invention relates to the field of current mirrors, particularly as used in integrated circuits.

2. Prior Art

Current mirrors are very frequently used in integrated circuits to set bias currents for various parts of the circuit. Typically the currents of one or more current sources, such as a current source that is independent of temperature or proportional to absolute temperature, is mirrored to various parts of a circuit so that one (or a very few) current sources may be mirrored to numerous sub-circuits for biasing purposes. In other cases, current mirrors may be used in the signal path itself, mirroring a signal current of one sub-circuit to one or more other sub-circuits. Whatever the application of the current mirror, the accuracy and/or sensitivity of the current mirror to such parameters as power supply noise and β (beta) variation of the transistors used (junction transistors in this example) with process variations and collector current frequently has a very substantial effect on the performance of the circuit. Reduction in such sensitivities can substantially improve circuit performance, or reduce power supply filtering requirements, or both.

By way of example, the well-known PNP current mirror circuit is shown in FIG. 1. The output current $I_O$ is:

$$I_O=I_{IN}/(1+(p+1)/\beta_{PNP})$$

Where:

$I_{IN}$=the input current to the current mirror p=the area ratio of transistor Q2 to transistor Q1

$\beta_{PNP}$=the ratio of collector current to base current for the PNP transistors Q1 and Q2

The current multiplication error is set by the $\beta_{PNP}$ parameter value. For most cases this parameter has a low value (10 to 50) and is rapidly falling at high collector currents. The output current sensitivity to $\beta_{PNP}$ variation is:

$$(\Delta I_O/I_O)/(\Delta\beta_{PNP}/\beta_{PNP})\approx(1+p)/\beta_{PNP}$$

The output current sensitivity to power supply voltage variation is:

$$(\Delta I_O/\Delta V+)/I_O\approx 1/V_{AP}$$

BRIEF SUMMARY OF THE INVENTION

Low voltage, fast settling precision current mirrors and methods. The precision current mirror have first and second current mirrors, each having an input to be mirrored and a mirror output, the current mirrors being coupled so that the mirror output of each current mirror receives part of the input to be mirrored by the other current mirror, the first current mirror also mirroring current for re-mirroring to the input of the second current mirror, and to a precision current mirror output in proportion to the current provided to the input of the second current mirror. Various embodiments are disclosed, including MOS and junction transistor embodiments, and embodiments having increased output impedance.

DETAILED DESCRIPTION OF THE PREFERRED EMBODIMENT

Figure 2:
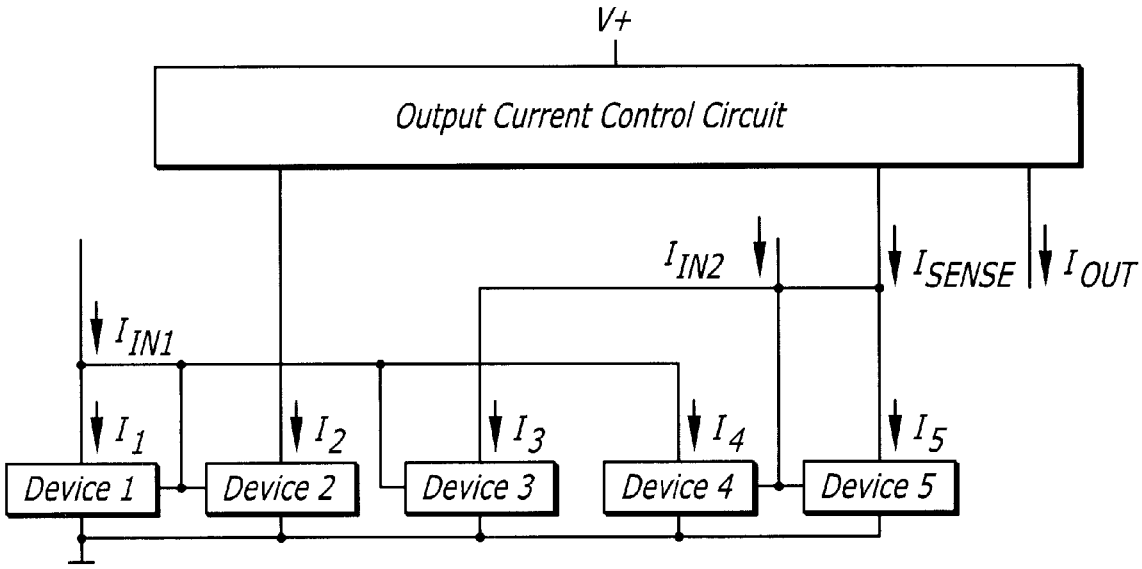
FIG. 2 is a simplified circuit diagram of an embodiment of the invention.

Now referring to FIG. 2, a simplified circuit of an embodiment of the invention may be seen. In this embodiment, the active devices, Device1 to Device5, are n-type transistors (bipolar or field-effect). Device1, Device2, Device3 and Device4, Device5, respectively, are matched devices. Device1 and Device5 are diode-connected. Thus, the impact of collector/drain to emitter/source voltage (Early voltage) upon the transfer characteristics of Device1, Device2, Device4 and Device5 is minimal. Thus I1=I3, and I4=I5.

For simplicity of illustration, assume that the current flowing into the control terminals of each transistor is negligible. With this assumption:

$$I_{IN1}=I1+I4 \text{ and } I_{SENSE}+I_{IN2}=I3+I5$$

This yields:

$$I_{SENSE}-(I_{IN1}-I_{IN2})=(I3-I1)+(I5-I4)=0$$

Therefore:

$$I_{SENSE}=I_{IN1}-I_{IN2}$$

The current I2 is the input to the Output Current Control Circuit, providing appropriate functionality of the feedback system. This block has such a structure that we may assume that $I_{OUT}=m*I_{SENSE}$. Based on the previous result:

$$I_{OUT}=m*(I_{IN1}-I_{IN2})$$

Where:

m=a multiplying factor normally realized by a ratio of transistor sizes

Thus the source output current, $I_{OUT}$, is precisely controlled by the difference in the input currents ($I_{IN1}-I_{IN2}$), Similarly, if devices Device1 to Device5 are p-type and the Output Current Control Circuit is correspondingly changed, then the output sink-current, $I_{OUT}$, is proportional to the difference in the input sink-currents, $I_{IN1}-I_{IN2}$.

Figure 3:
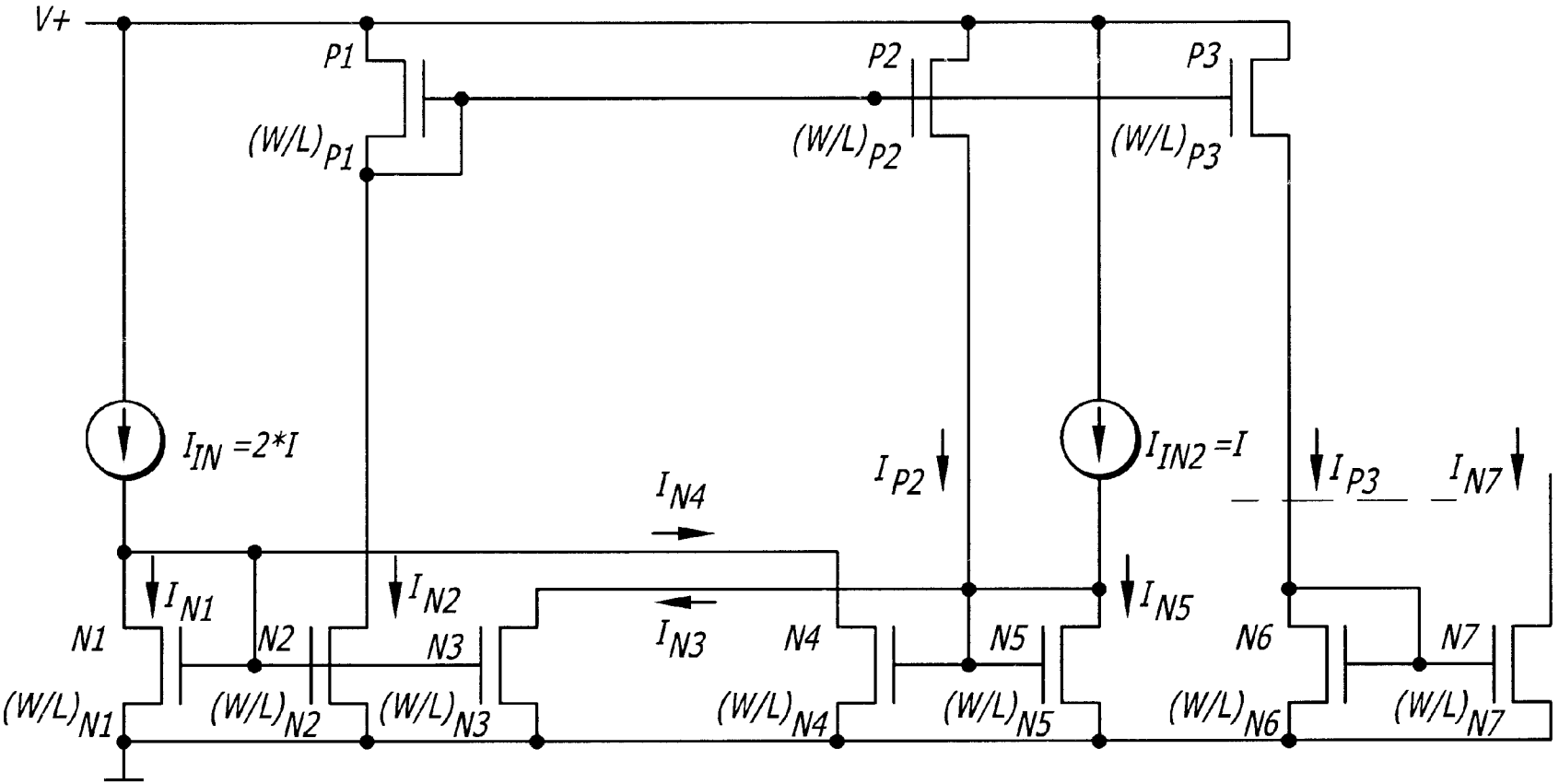
FIG. 3 is a circuit diagram for an embodiment of the invention using n-channel MOS transistors as the active devices.

FIG. 3 is a circuit diagram for an embodiment of the invention using MOS transistors as the active devices. The input signal is applied in two places through the currents $I_{IN1}=2*I$ and $I_{IN2}=I$. The input currents $I_{IN1}$, $I_{IN2}$ can have any relative values, though for optimum performance, the ratio between these two currents $I_{IN1}/I_{IN2}$ should be two.

In the following analysis, it is assumed that NMOS transistors N1, N2, N3 and N4, N5 are matched, having the same aspect ratio $(W/L)_{N1}=(W/L)_{N2}=(W/L)_{N3}$, and $(W/L)_{N4}=(W/L)_{N5}$.

PMOS transistors P1, P2 are matched, having the same aspect ratio $(W/L)_{P1}=(W/L)_{P2}$. PMOS transistor P3 is an exact multiple of transistor P2: $(W/L)_{P3}/(W/L)_{P2}=M_P$. Similarly, NMOS transistor N7 is an exact multiple of the transistor N6: $(W/L)_{N7}/(W/L)_{N6}=M_N$.

For simplicity, assume that the diode-connected transistors N1, N5 and N6 have the same $V_{GS}$ (gate-source voltage). Thus transistors N1, N3 have the same $V_{GS}$ and equal $V_{DS}$ (drain-source voltage) Transistors N4, N5 have the same $V_{GS}$ and equal $V_{DS}$. Transistors 22 and P3 have the same $V_{GS}$ and equal $V_{DS}$.

Also assume that all NMOS and PMOS devices operate in the strong inversion region. Therefore, the square law applies:

$$I_D=K^*(V_{GS}-V_T)^{2*}(1+\lambda^*V_{DS})$$

Where:

K=a constant $V_{GS}$=the gate to source voltage $V_T$=the threshold voltage of the transistor $\lambda=1/V_A$ $$V_A=\frac{I_D}{\frac{\partial I_D}{\partial V_{DS}}}$$

$I_D$=the drain current $V_{DS}$=the drain to source voltage

Based on the above:

$$I_{N1}=I_{N3},\ I_{N4}=I_{N5} \text{ and } I_{P3}=M_P{}^*I_{P2}$$

By simple inspection of the circuit:

$$I_{N1}+I_{N4}=2^*I \text{ and } I_{N3}+I_{N5}=I_{P2+I}$$

From the foregoing two sets of equations:

$$I_{P2}=I \text{ and } I_{P3}=M_P{}^*I$$

The result obtained in the foregoing equation shows that the proposed circuit generates a current $I_{P3}$ that is a precise multiple of the input current I. Further, the current $I_{P3}$ is multiplied by the current mirror formed by transistors N6,N7 generating the output current $I_{N7}$. This circuit contains a composite negative-positive feedback: transistor N4 closes the negative feedback path (primary loop), while transistor N3 closes the positive feedback path (secondary loop).

The loop-gain is kept low due to the diode-connected transistors N1 and N5. The loop should be stable without any additional compensation, though if needed, compensation can be added, such as by a capacitor connected between the gate of transistor N1 and ground.

The supply voltage rejection can be simply explained as follows: the supply voltage variation will change $I_{P2}$; the feedback loop action will change $I_{N1}$ and $I_{N4}$ in opposite directions, therefore canceling out the variation of $I_{P2}$ and, consequently, the variation of $I_{P3}$.

The improvement in power supply rejection with regard to $I_{P3}$ current compared to the traditional cascaded current mirror solution can be estimated with the following formula:

$$(\Delta I_{P3}/\Delta V+)/I_{P3}|_{NEW}/(\Delta I_{P3}/\Delta V+)/I_{P3}|_{OLD}\approx(V_{GSS}-V_T)^*(\lambda_P+\lambda_N)/2.$$

Where:

V+=the positive power supply voltage

This circuit improves the power supply rejection by at least an order of magnitude compared to the traditional solution with cascaded simple current mirrors.

There are three major points of merit associated with this circuit:

1) The minimum supply voltage is $(V+)_{min}=V_{GS}+(V_{DS})_{sat}\approx 1.1V$.
2) Improved power supply rejection compared to simple current mirrors.
3) Fast settling time; the AC response of the circuit is excellent (normally, no compensation network is required).

Figure 4:
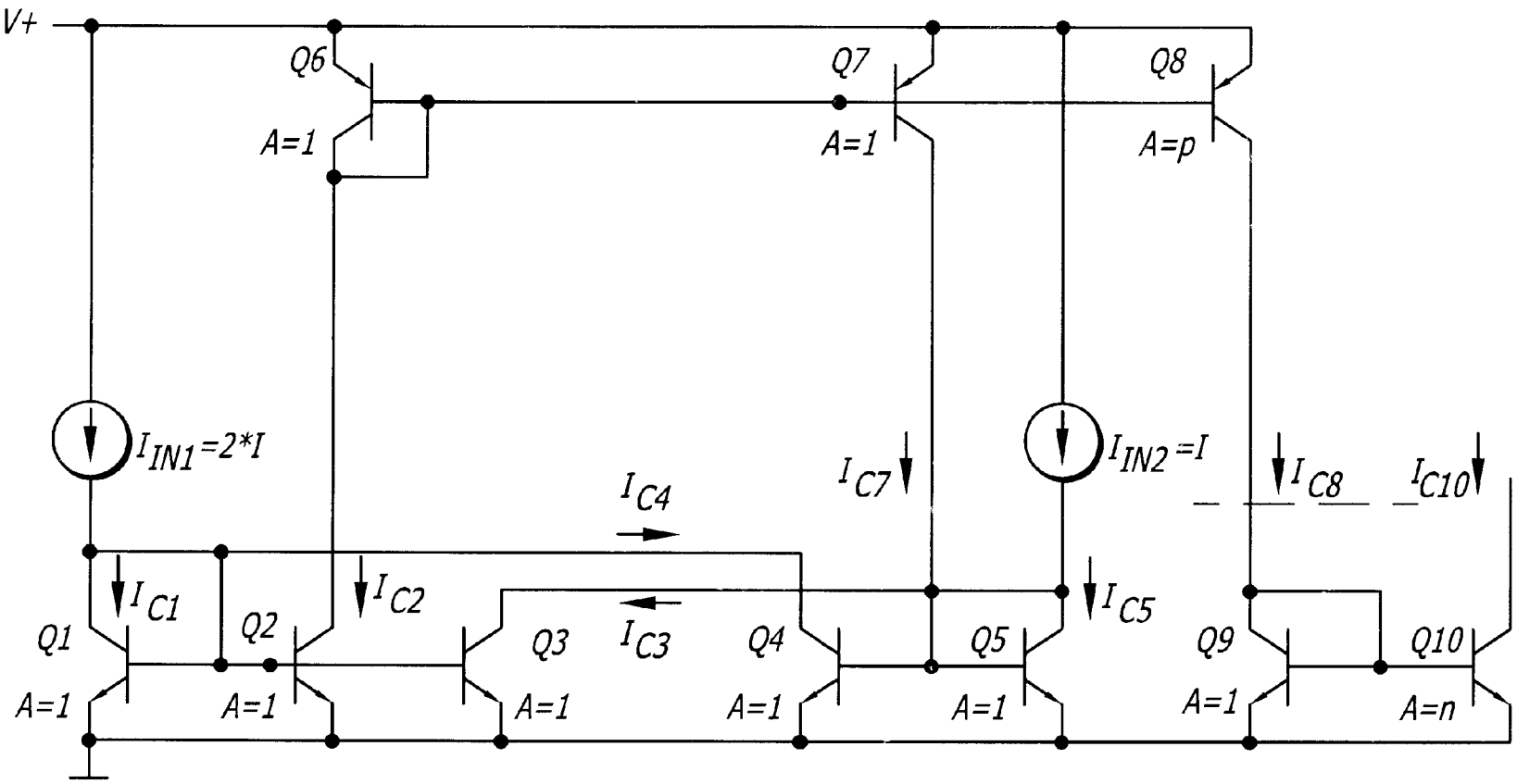
FIG. 4 is a circuit diagram for another embodiment using bipolar transistors as the active devices.

FIG. 4 is a circuit diagram for another embodiment using bipolar transistors as the active devices. This circuit generates an output current $I_{C8}$, which is a precise multiple of the input current difference $(I_{IN1}-I_{IN2})$:

$$I_{C8}=p^*(I_{IN1}-I_{IN2})$$

Where:

p=the ratio of the area of transistor Q8 and transistor Q6 or Q7

$I_{C8}$ is applied to the current mirror formed by transistors Q9,Q10. The circuit functionality is similar to that presented in the previous embodiment.

In this circuit:

$$V_{BE1}=V_{BE3},\ V_{BE4}=V_{BE5} \text{ and } V_{EB7}=V_{EB8}$$

The voltage drop across the diode-connected transistors Q1, Q5, Q9 may be considered to be the same. Therefore:

$$V_{CE1}=V_{CE3},\ V_{CE4}=V_{CE5} \text{ and } V_{EC7}=V_{EC8}$$

$$I_{C1}=I_{C3},\ I_{C4}=I_{C5} \text{ and } I_{C8}/I_{C7}=p$$

Neglecting the base currents for the moment:

$$I_{IN1}=I_{C1}+I_{C4}$$

$$I_{C3}+I_{C5}=I_{C7+IIN2}=I_{C8}/p+I_{IN2}$$

$$I_{C8}=p^*(I_{IN1}-I_{IN2})=p^*I$$

The precise control of the current $I_{C8}$ is achieved through a negative-positive feedback loop: transistor Q4 closes a negative feedback path while transistor Q3 closes a positive feedback path. The loop gain is kept low due to the low impedance diode-connected transistors Q1 and Q5. In most cases, this enables the loop to be AC-stable without any additional compensation network. If needed, a capacitor connected between the base and emitter of transistor Q1 can be added.

The frequency response of this circuit is excellent, providing fast settling. Some merits of this circuit can be evaluated through the following formulas, derived from circuit analysis:

$I_{C8}$ sensitivity to $\beta_{PNP}$ variations is:

$$(\Delta I_{C8}/I_{C8})/(\Delta\beta_{PNP}/\beta_{PNP})\cong 5^*(p+2)/(\beta_{PNP}{}^*\beta_{NPN})$$

$I_{C8}$ sensitivity to $\beta_{NPN}$ variations:

$$(\Delta I_{C8}/I_{C8})/(\Delta\beta_{NPN}/\beta_{NPN})\cong(5/\beta_{NPN})^*(1+(p+2)/\beta_{PNP}-0.4^*I_{IN1}/(I_{IN1}-I_{IN2}))$$

Considering $I_{IN1}=2^*$ I, $I_{IN2}=I$ then:

$$(\Delta I_{C8}/I_{C8})/(\Delta\beta_{NPN}/\beta_{NPN})\cong(5/\beta_{NPN})^*(0.2+(p+2)/\beta_{PNP})$$

$I_{C8}$ sensitivity to V+ variations:

$$(\Delta I_{C8}/I_{C8})/(\Delta V+)\cong(5/\beta_{NPN})*(1+(p+2)/\beta_{PNP})/V_{AP}$$

Where:

$V_{AP}=V_A$ for the $\beta_{PNP}$ transistors

Figure 1:
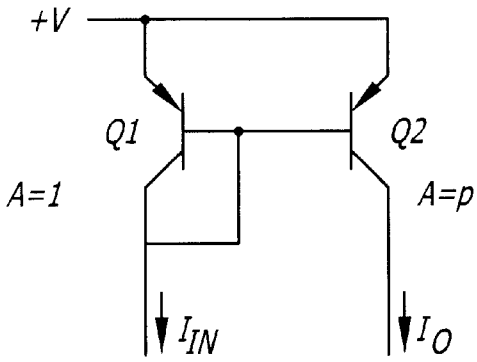
FIG. 1 (Prior Art)
FIG. 1 is a circuit diagram for a prior art PNP current mirror circuit.

The performance improvement of the proposed circuit in FIG. 4 with regard to that of the circuit in FIG. 1 can be derived from the above equations:

Output current sensitivity to $\beta_{PNP}$ variation:

$$(\Delta I_O/I_O)/(\Delta\beta_{PNP}/\beta_{PNP})|_{NEW}/(\Delta I_O/I_O)/(\Delta\beta_{PNP}/\beta_{PNP}|_{OLD}\cong 5/\beta_{NPN}$$

Output current sensitivity to supply variation:

$$(\Delta I_O/\Delta V+)/I_O|_{NEW}/(\Delta I_O/\Delta V+)/I_O|_{OLD}\approx(5/\beta_{NPN})*(1+(p+2)/\beta_{PNP})$$

The above equations show that this novel circuit of FIG. 4 improves the performance by at least an order of magnitude compared to the traditional solution with a simple current mirror of FIG. 1. There are three major points of merit associated with this novel circuit:

1) The minimum supply voltage is $(V+)_{min}=V_{BE}+(V_{CE})_{sat}\approx 0.9V$.
2) Improved power supply rejection compared to simple current mirrors.
3) Fast settling time; the AC response of the circuit is excellent (normally, no compensation network is required).

Figure 5:
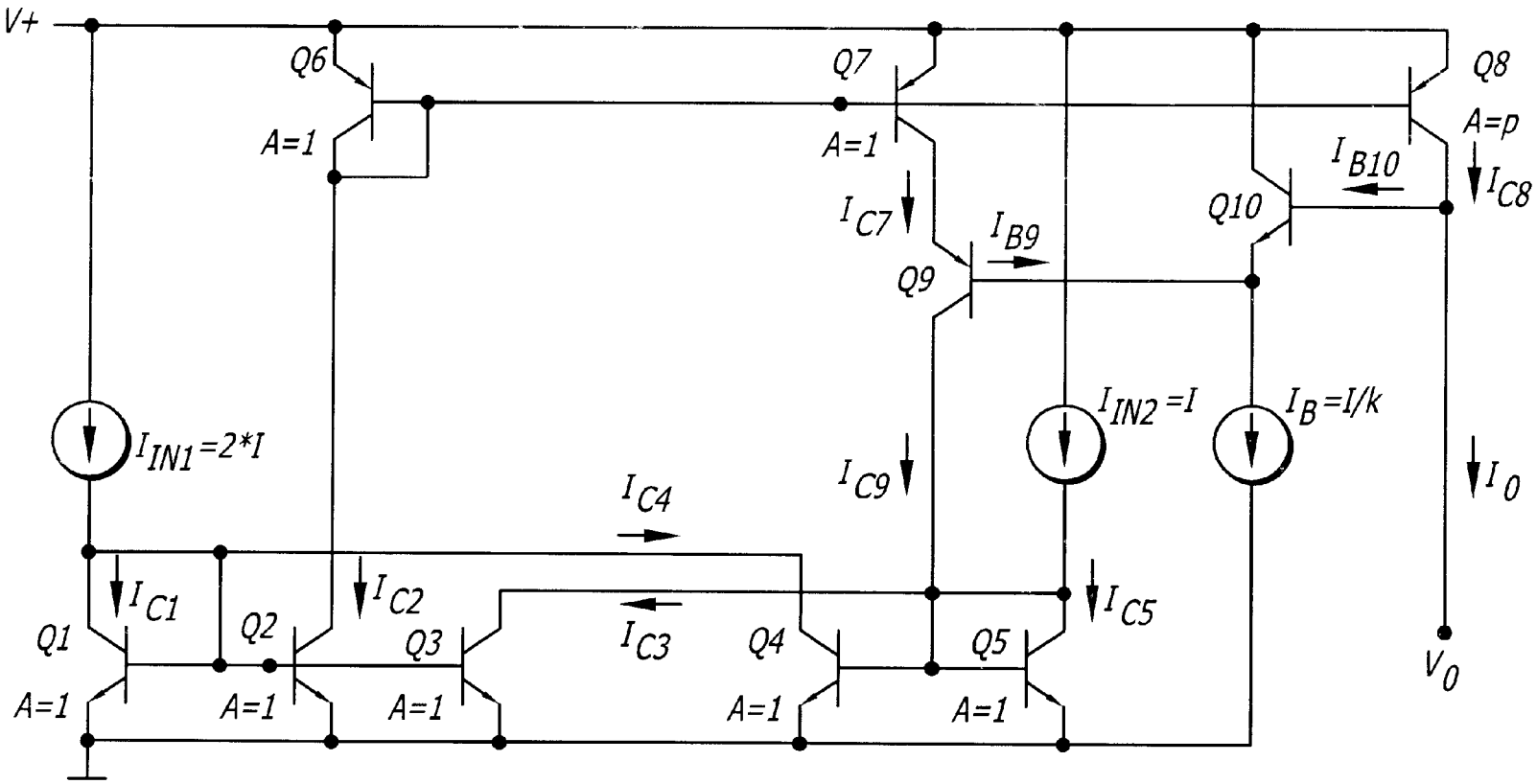
FIG. 5 is a circuit diagram for a version of the embodiment of FIG. 4, but having an improved (higher) output impedance.

FIG. 5 is a circuit diagram for a version of the previous embodiment having an improved (higher) output impedance. The functionality of the circuit in FIG. 5 is similar to that presented with respect to the embodiment of FIG. 4, and generally the analytical results for that embodiment apply to this embodiment as well. The addition of transistor Q9, which forms a cascode with transistor Q7, together with transistor Q10, increases the output impedance roughly by an order of magnitude. In particular, as a first order approximation, $V_{BE10}=V_{EB9}$. Thus the collector voltage of transistor Q7 will always be substantially equal to the collector voltage of transistor Q8. This causes the current $I_{C8}$ to very accurately track $p*I^{C7}$ throughout the output voltage range. Also, to the extent that the base current $I_{B10}$ approximates p times the base current $I_{B9}$, the output current $I_O$ will very accurately track $p*I_{C9}$ over the output voltage range. The minimum output voltage compliance is:

$$(V+)-V_O=V_{EC7}+(V_{EB9}-V_{BE10})\cong V_{EC7}\approx(V_{EC7})_{sat}$$

Figure 6:
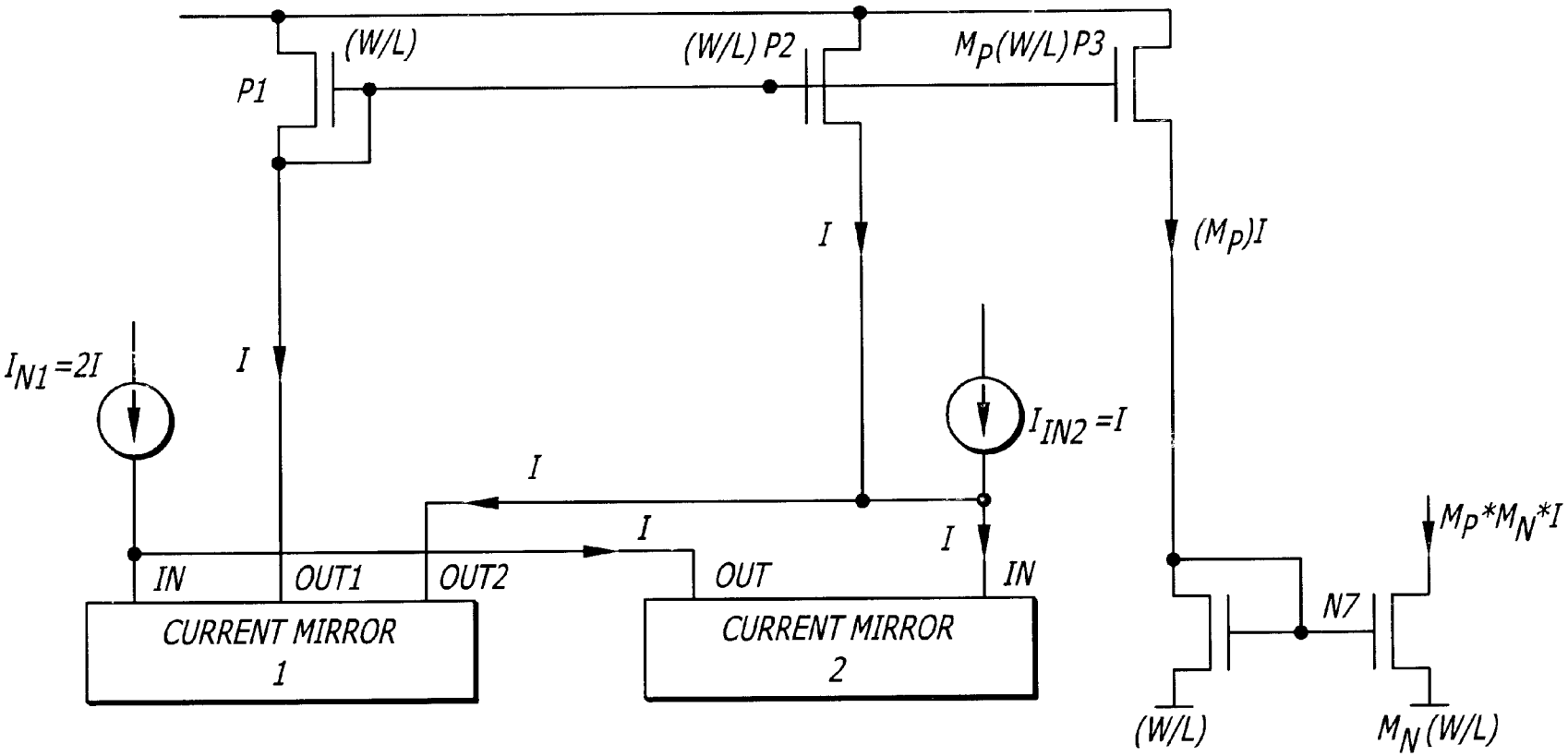
FIG. 6 is a diagram of a generalized form of the embodiment of the present invention shown in FIG. 3.

A generalized form of one embodiment of the present invention may be seen in FIG. 6. As shown therein, the precision current mirror comprises first (current mirror 1) and second (current mirror 2) current mirrors, each having an input ($I_{N1}$ and $I_{N2}$, respectively) to be mirrored and a mirror output (OUT2 and OUT, respectively), the current mirrors being coupled so that the mirror output of each current mirror (OUT2 and OUT, respectively), receives part of the input ($I_{N1}$ and $I_{N2}$, respectively) to be mirrored by the other current mirror, the first current mirror also mirroring current (OUT1) for re-mirroring (I) to provide part of the input of the second current mirror, and to a precision current mirror output $M_pI$ in proportion to the current provided to the input of the second current mirror. FIG. 5 also has a mirror on the output, providing a final output of $M_pM_nI$.

Figure 7:
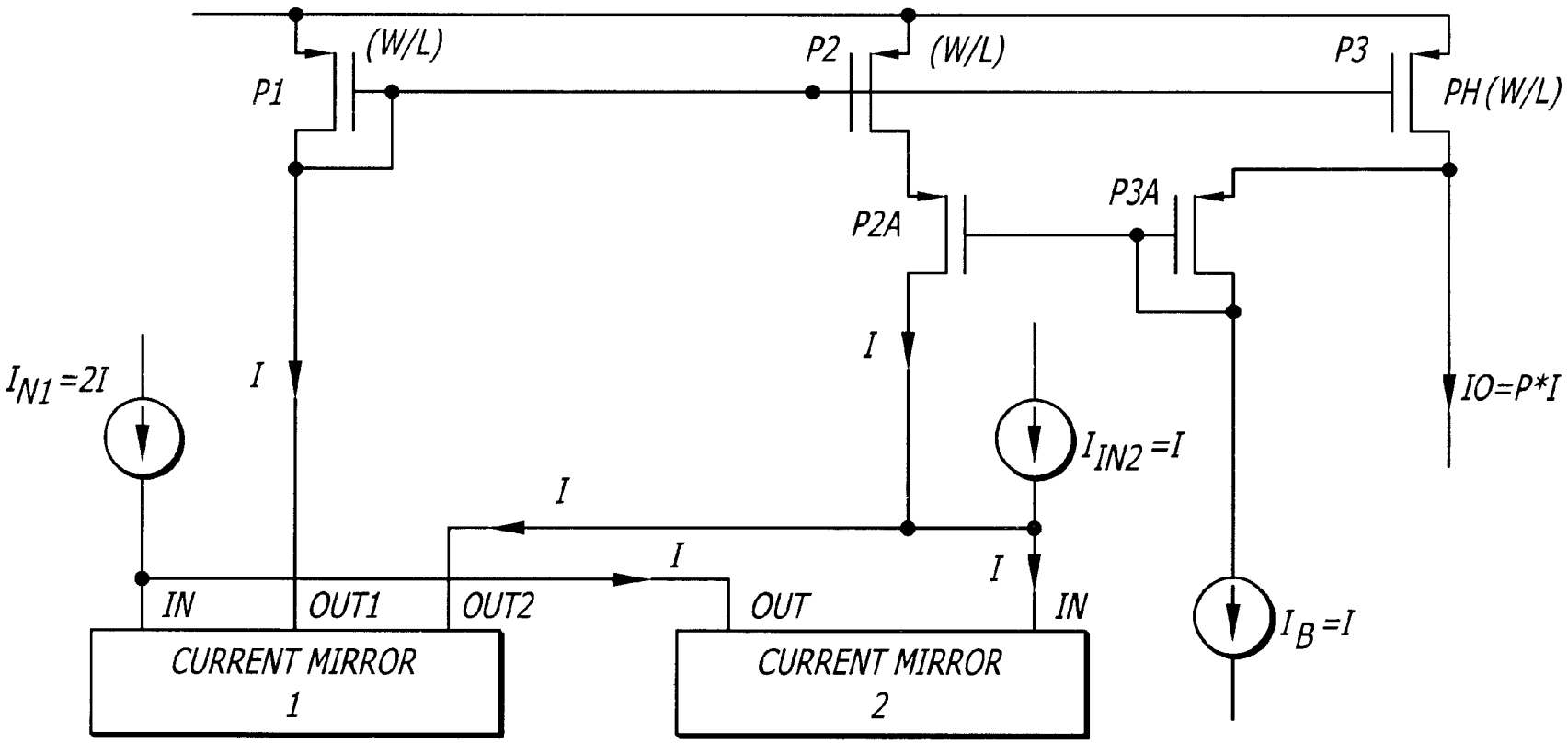
FIG. 7 is a diagram of a generalized form of an embodiment of the present invention similar to FIG. 6, but with the additional transistors P2A and P3A to further increase the output impedance of the circuit.

FIG. 7 is similar to FIG. 6, though with the addition of transistors P2A and P3A, two transistors F. preferably with the same threshold voltage. Thus the drain potential of transistor P2 will follow the drain potential of transistor P3, therefore achieving a high output impedance. In general, any mirror circuits using any transistor and conductivity types can be used in the circuits of the present invention as desired.

Obviously, as is well known in the art, any of the exemplary circuits, and obvious modifications thereof, may be realized by devices of the opposite conductivity type by flipping the applicable circuit diagram about a horizontal axis and reversing the current flow directions, so that the circuits previously acting as sources become sinks, and circuits previously acting as sinks become sources. Thus while the present invention has been disclosed and described with respect to certain preferred embodiments thereof, it will be understood to those skilled in the art that the present invention may be varied without departing from the spirit and scope thereof.

What is claimed is:

1. A current mirror comprising:

first through fifth semiconductor devices and an output current control circuit;

a first component of the current to be mirrored being coupled to a common connection of the first and fourth semiconductor devices;

a second component of the current to be mirrored being coupled to a common connection of the third and fifth semiconductor devices;

the current in the first device being mirrored to the second and third semiconductor devices;

the current in the fifth semiconductor device being mirrored to the fourth semiconductor device;

the output current control circuit having one output coupled to the common connection of the third and fifth semiconductor devices and responsive to the current in the second semiconductor device to mirror the current in the second semiconductor device to the fifth and third semiconductor devices and to a current mirror output.

2. The current mirror of claim 1 wherein the first, second and third semiconductor devices are matched devices, and the fourth and fifth semiconductor devices are matched devices.

3. The current mirror of claim 1 wherein the first component of current to be mirrored is twice the second component of current to be mirrored.

4. The current mirror of claim 1 wherein the semiconductor devices are bipolar transistors.

5. The current mirror of claim 1 wherein the semiconductor devices are MOS transistors.

6. The current mirror of claim 1 wherein the output current control circuit comprises sixth, seventh and eighth semiconductor devices, the sixth semiconductor device being coupled to the second semiconductor device and responsive to the current in the second semiconductor device to mirror the current in the second semiconductor device to the seventh and eighth semiconductor devices, the seventh semiconductor device being coupled to the fifth and third semiconductor devices, and the eighth semiconductor device providing the current mirror output.

7. The current mirror of claim 6 wherein the sixth, seventh and eighth semiconductor devices are complimentary semiconductor devices to the first through fifth semiconductor devices.

8. The current mirror of claim 7 wherein the sixth and seventh semiconductor devices are the same size and the eighth semiconductor device is a different size than the sixth and seventh semiconductor devices.

9. The current mirror of claim 7 further comprised of a circuit causing the voltages on the seventh and eighth transistor devices to track.

10. A method of mirroring current comprising:

coupling a first component of the current to be mirrored to a common connection of first and fourth semiconductor devices;

coupling a second component of the current to be mirrored to a common connection of third and fifth semiconductor devices;

mirroring the current in the first device to second and third semiconductor devices;

mirroring the current in the fifth semiconductor device to the fourth semiconductor device; and, mirroring the current in the second semiconductor device to the common connection of the fifth and third semiconductor devices and to a current mirror output.

11. The method of claim 10 wherein the first, second and third semiconductor devices are matched devices, and the fourth and fifth semiconductor devices are matched devices.

12. The method of claim 10 wherein the first component of current to be mirrored is twice the second component of current to be mirrored.

13. The method of claim 10 wherein the semiconductor devices are bipolar transistors.

14. The method of claim 10 wherein the semiconductor devices are MOS transistors.

15. A precision current mirror comprising first and second current mirrors, each having an input to be mirrored and a mirror output, the current mirrors being coupled so that the mirror output of each current mirror receives part of the input to be mirrored by the other current mirror, the first current mirror also mirroring current for re-mirroring to provide part of the input of the second current mirror, and to a precision current mirror output in proportion to the current provided to the input of the second current mirror.

16. The precision current mirror of claim 15 wherein the input to be mirrored by the first current mirror is twice the input to be mirrored by the second current mirror.

17. A method of mirroring current comprising:

providing a first current to be mirrored to a first current mirror and as part of the output of a second current mirror;

providing a second current to be mirrored to a second current mirror and as part of the output of a first current mirror; and also, mirroring current of the first current mirror to the input of the second current mirror, and to a precision current mirror output in proportion to the current provided to the input of the second current mirror.

18. The method of claim 17 wherein the first current to be mirrored is twice the second current to be mirrored.

* * * * *